US010508325B2

(12) United States Patent
Somani et al.

(10) Patent No.: US 10,508,325 B2
(45) Date of Patent: Dec. 17, 2019

(54) CORROSION-RESISTANT ALUMINUM ALLOY FOR HEAT EXCHANGER

(71) Applicant: Brazeway, Inc., Adrian, MI (US)

(72) Inventors: Vikas Somani, Sylvania, OH (US); Alfred Wang, Adrian, MI (US); Scot Reagen, Sylvania, OH (US)

(73) Assignee: Brazeway, Inc., Adrian, MI (US)

( * ) Notice: Subject to any disclaimer, the term of this patent is extended or adjusted under 35 U.S.C. 154(b) by 271 days.

(21) Appl. No.: 15/184,250

(22) Filed: Jun. 16, 2016

(65) Prior Publication Data

US 2016/0369377 A1 Dec. 22, 2016

Related U.S. Application Data

(60) Provisional application No. 62/181,493, filed on Jun. 18, 2015.

(51) Int. Cl.
*C22C 21/00* (2006.01)
*C22F 1/04* (2006.01)

(52) U.S. Cl.
CPC ..... *C22C 21/00* (2013.01); *C22F 1/04* (2013.01)

(58) Field of Classification Search
CPC ..... C22C 21/00; C22C 21/02; C22C 21/08; C22C 1/026; C22C 21/14
See application file for complete search history.

(56) References Cited

U.S. PATENT DOCUMENTS

| | | | | |
|---|---|---|---|---|
| 3,878,871 | A * | 4/1975 | Anthony | B32B 15/016 138/140 |
| 4,828,794 | A | 5/1989 | Scott et al. | |
| 5,037,707 | A | 8/1991 | Fortin et al. | |
| 5,286,316 | A | 2/1994 | Wade | |
| 6,153,025 | A | 11/2000 | Auran et al. | |
| 6,284,386 | B1 | 9/2001 | Jeffrey et al. | |
| 6,503,446 | B1 | 1/2003 | Ren et al. | |
| 6,656,296 | B2 | 12/2003 | Ren et al. | |
| 6,939,417 | B2 | 9/2005 | Marois et al. | |
| 7,767,042 | B2 | 8/2010 | Hasegawa et al. | |
| 8,025,748 | B2 | 9/2011 | Parson et al. | |
| 2001/0032688 | A1* | 10/2001 | Ren | C22C 21/00 148/549 |
| 2003/0150532 | A1* | 8/2003 | Marois | B21C 23/085 148/521 |
| 2006/0231170 | A1* | 10/2006 | Parson | C22C 21/00 148/437 |

* cited by examiner

*Primary Examiner* — Erin B Saad
(74) *Attorney, Agent, or Firm* — Harness, Dickey & Pierce, P.L.C.

(57) ABSTRACT

An extrudable aluminum alloy for a micro channel and round tube heat exchanger application including silicon in an amount that ranges between 0.15 and 0.30 wt %, iron in an amount that is less than or equal to 0.15 wt %, manganese in amount that ranges between 0.50 and 0.90 wt %, zinc in amount of no greater than 0.03 wt %, copper in amount of no greater than 0.03 wt %, and nickel in an amount of no greater than 0.01 wt %.

16 Claims, 13 Drawing Sheets

Max Extrusion Pressure difference between alloys

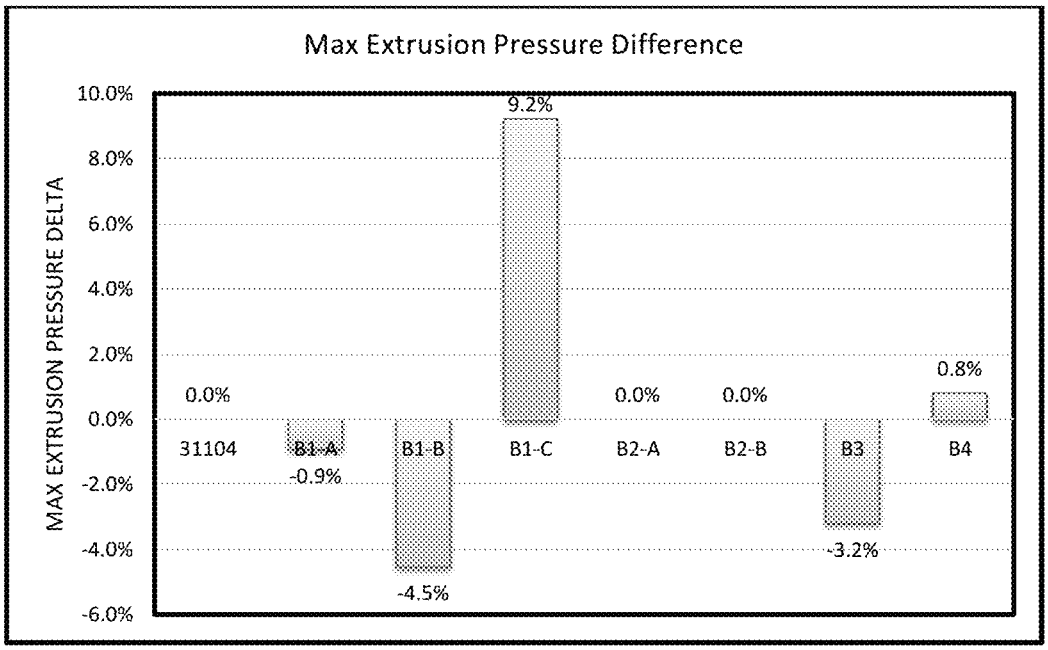
Fig 1: Max Extrusion Pressure difference between alloys
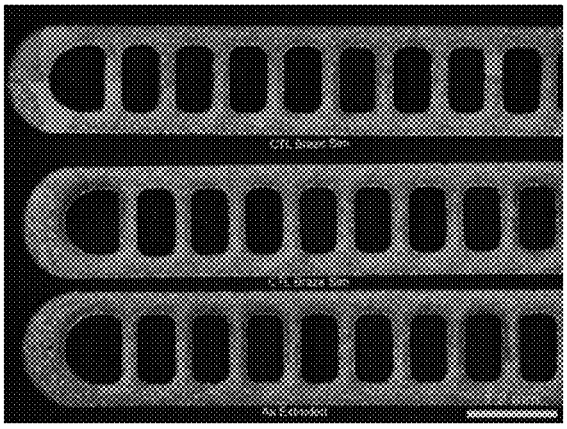
Fig 2. Grain structure of 31104 in as-extruded and post braze

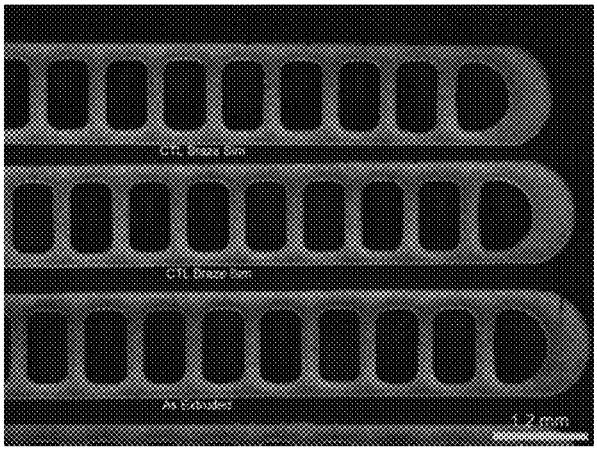
Fig 3. Grain structure of B1-A in as-extruded and post braze
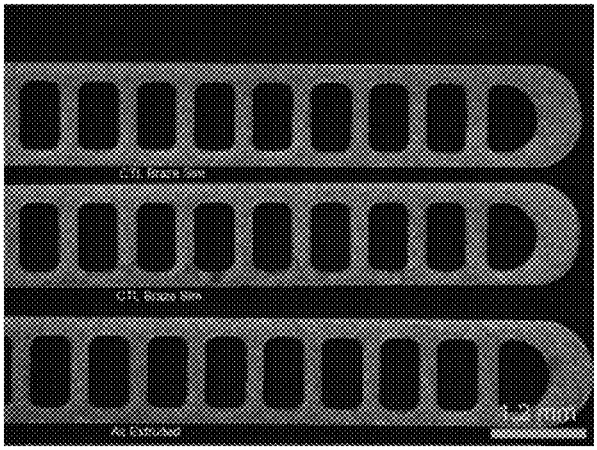
Fig 4. Grain structure of B1-B in as-extruded and post braze

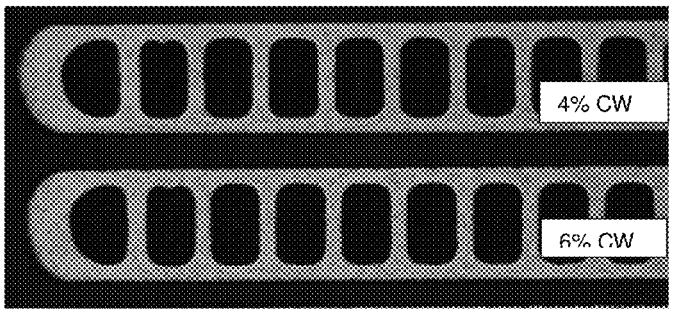
Fig 5. Post braze grain structure of B2-Awith different % cold work (brazed at 602C)
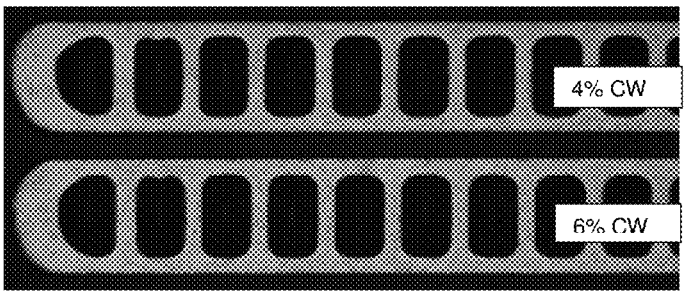
Fig 6. Post braze grain structure of B2-B with different % cold work (brazed at 602C)
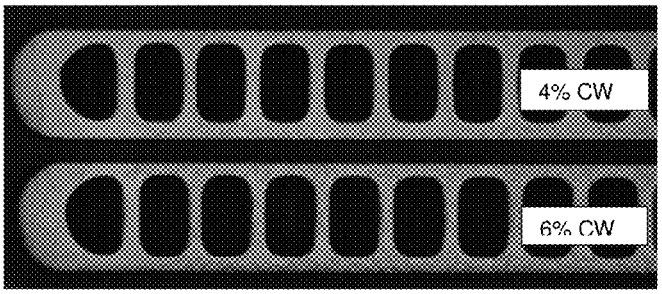
Fig 7. Post braze grain structure of 31104 with different % cold (brazed at 610C)

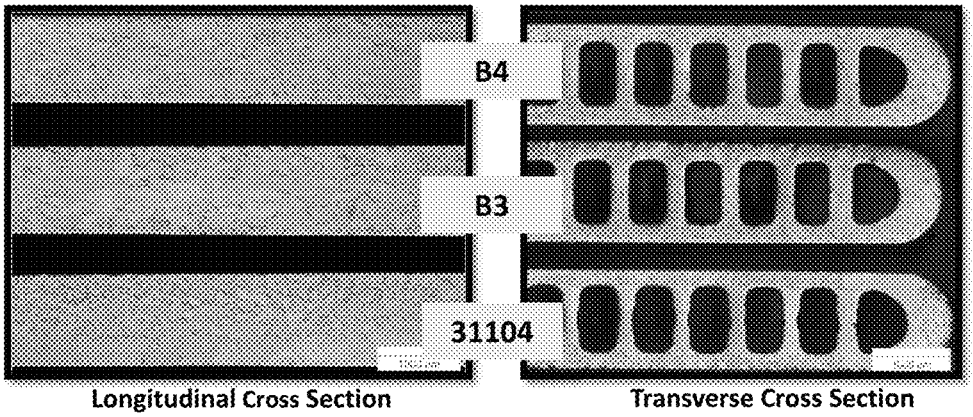
Fig 8. Grain structure in extruded and brazed tubes of 31104, BZY1 and BZY2 alloys
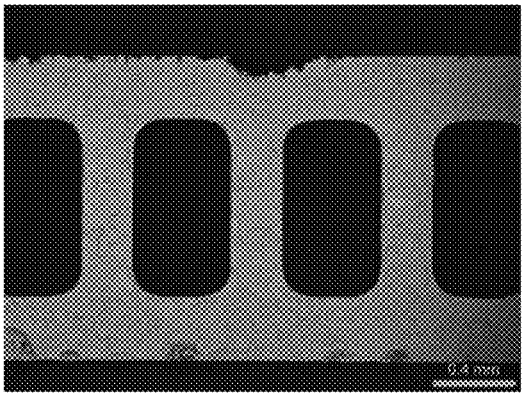
Fig 9. Corrosion in 31104 after 7 days in SWAAT

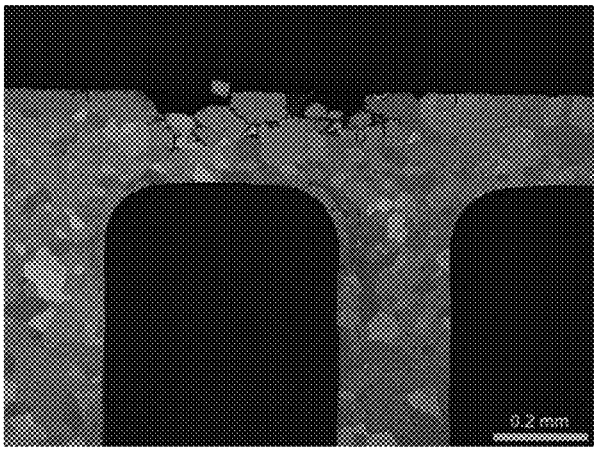
Fig 10. Corrosion in B1-A after 7 days in SWAAT
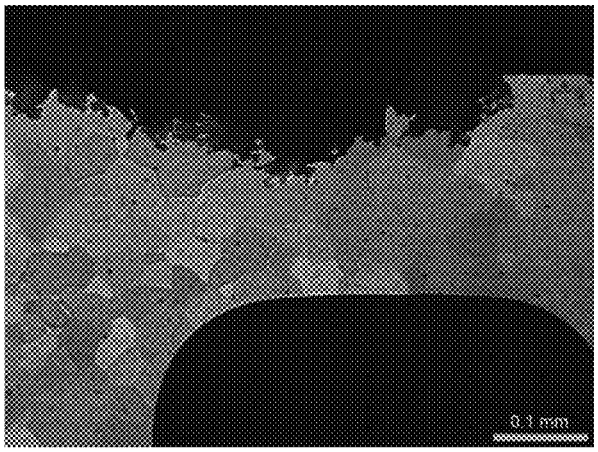
Fig 11. Corrosion in B1-B after 7 days in SWAAT

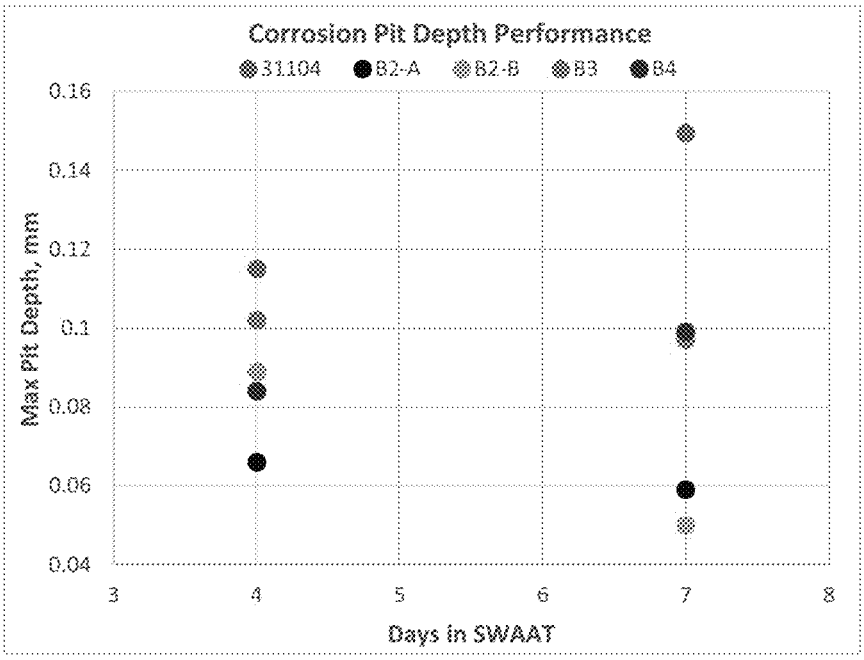
Fig 12. Corrosion Pit Depth of alloys in SWAAT
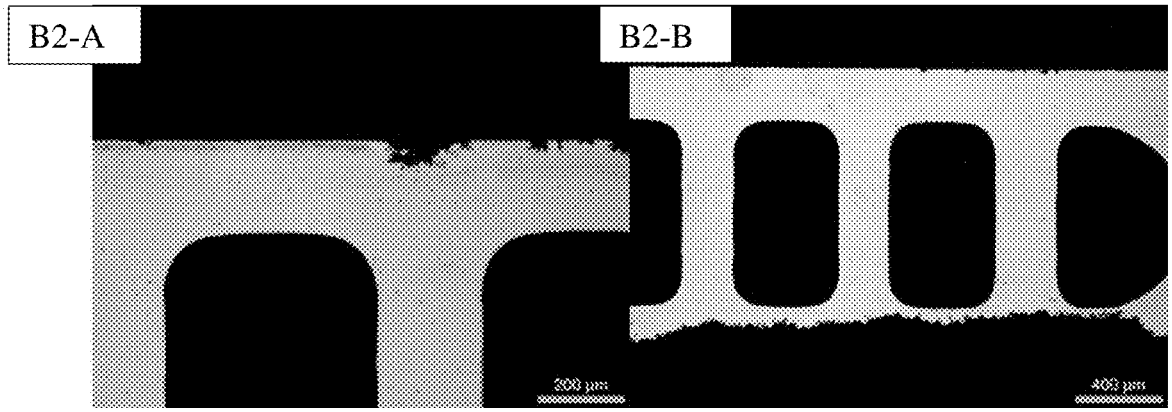
Fig 13. Pictures of tubes after 15 days in SWAAT test.

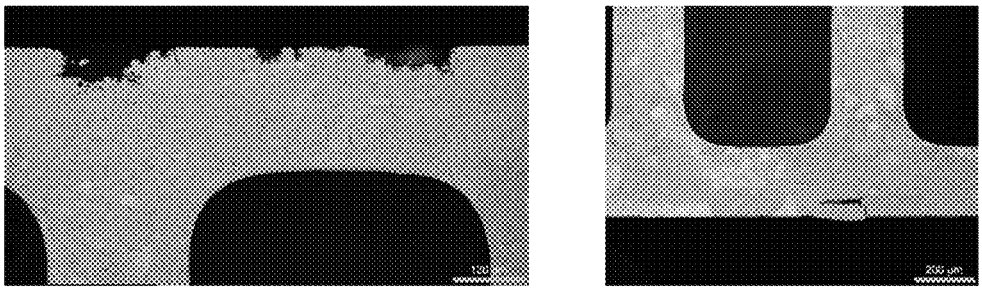
Fig 14. Grain etched pictures of corrosion in B2-A tubes after 15 days in SWAAT
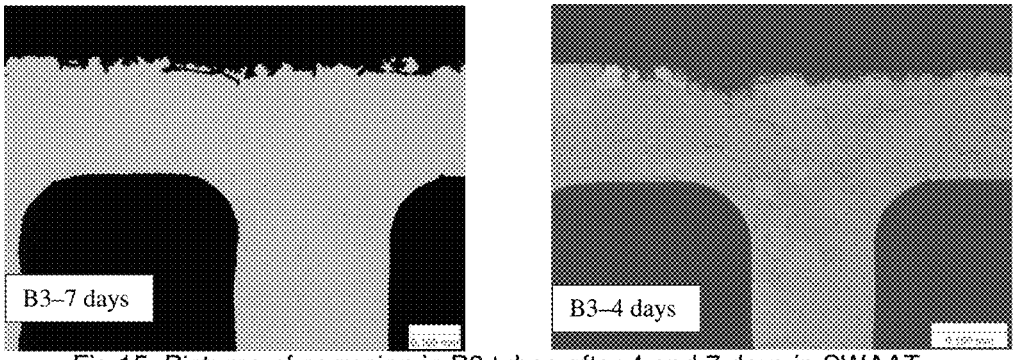
Fig 15. Pictures of corrosion in B3 tubes after 4 and 7 days in SWAAT
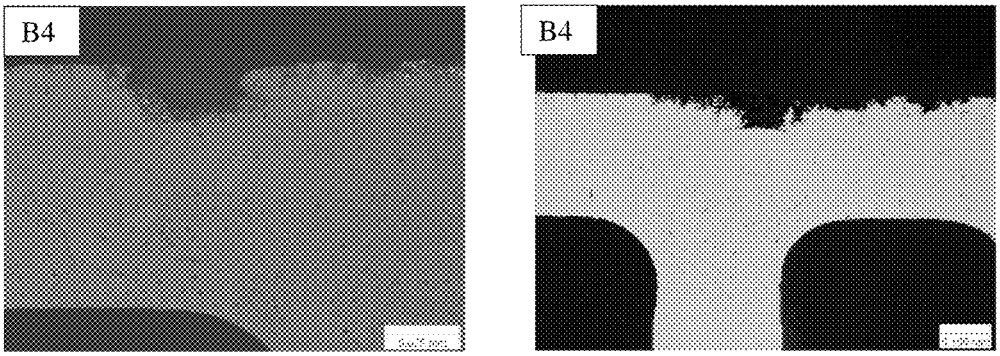
Fig 16. Pictures of corrosion in B4 tubes after 4 and 7 days in SWAAT

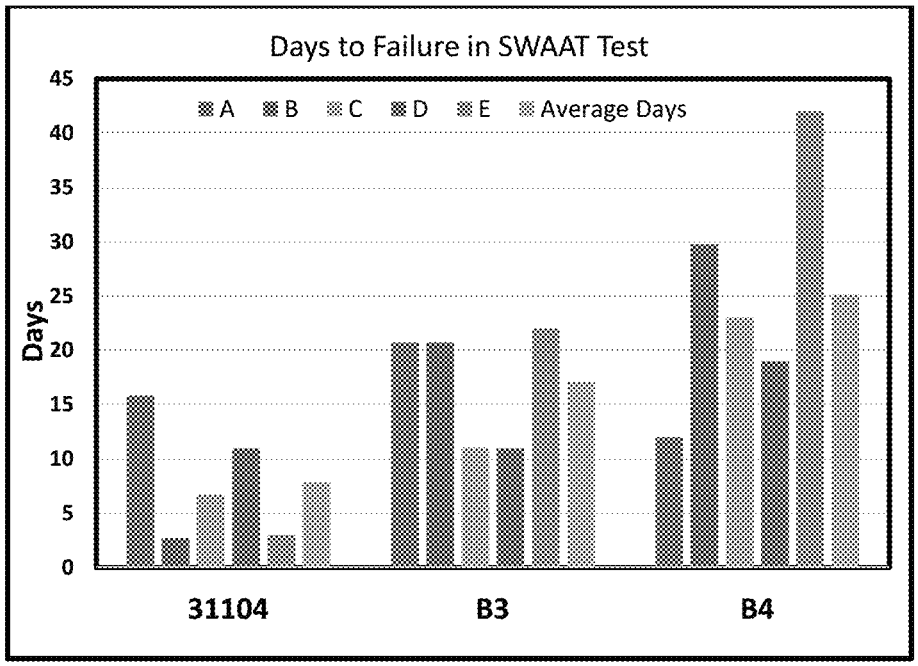
Fig 17. Days to failure in SWAAT for 31104, B3 and B4 alloys

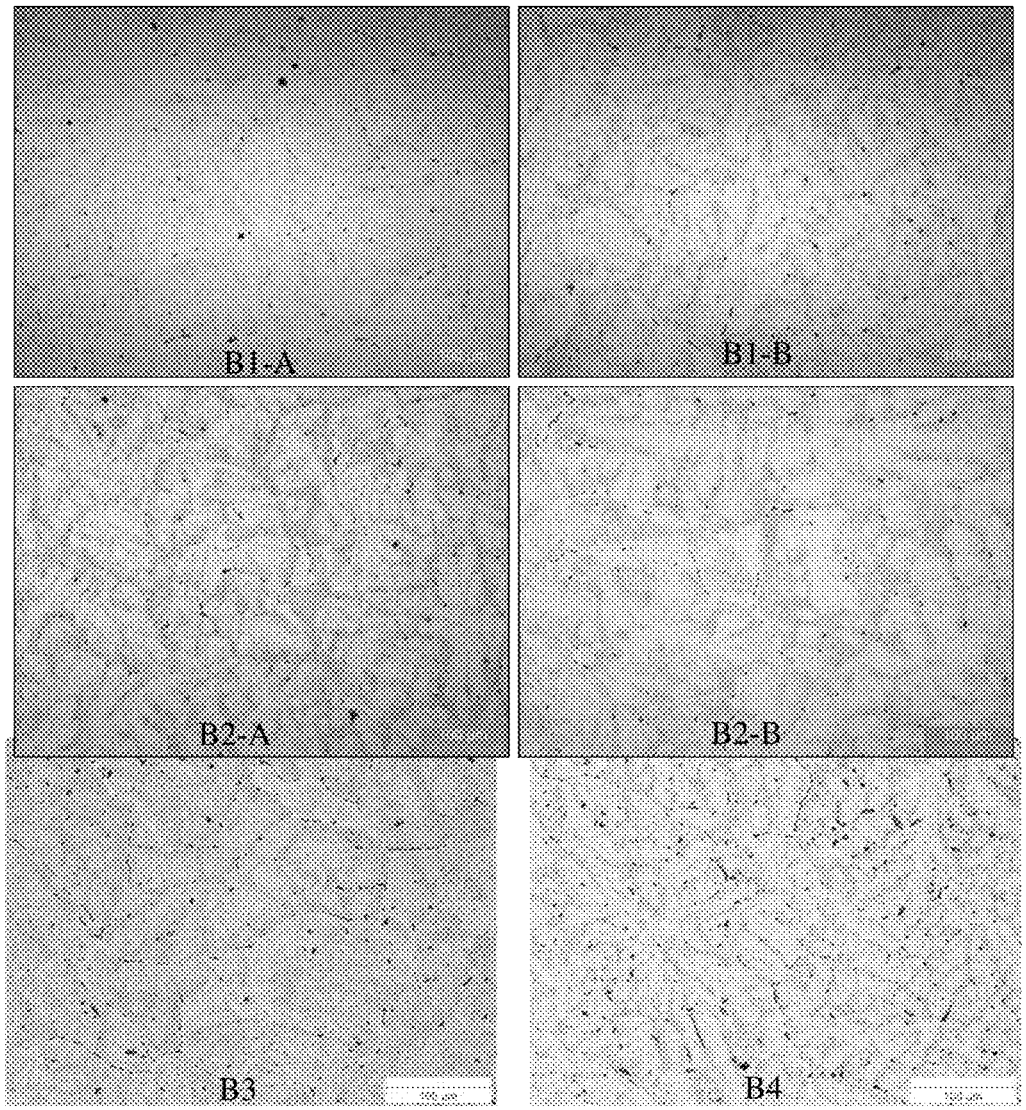
Fig 18. Billet microstructure of B1-A, B1-B, B2-A and B2-B.

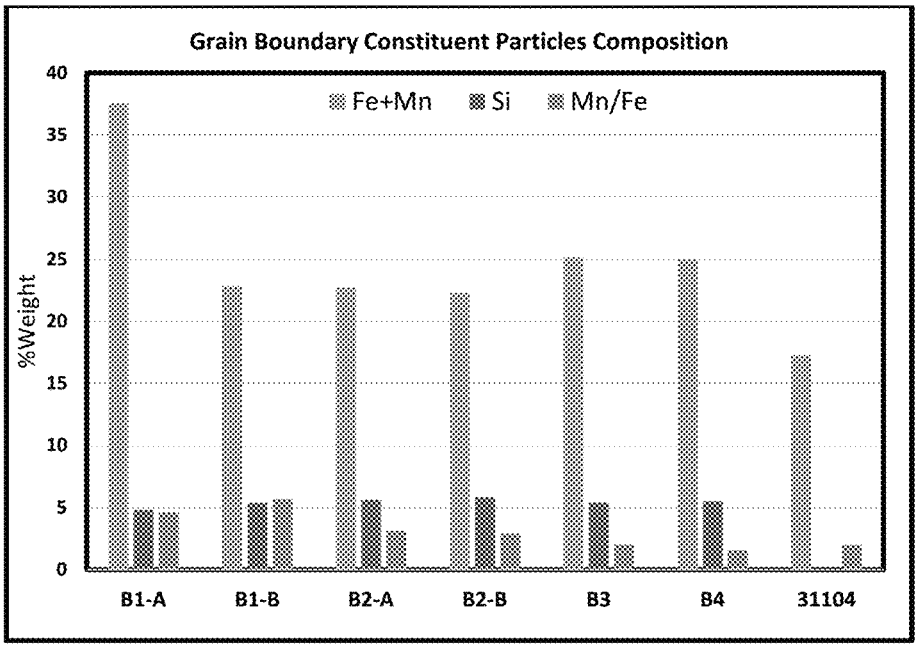
Fig 19. Average particle %weight composition of Constituent particles along grain boundaries determined by EDS analysis
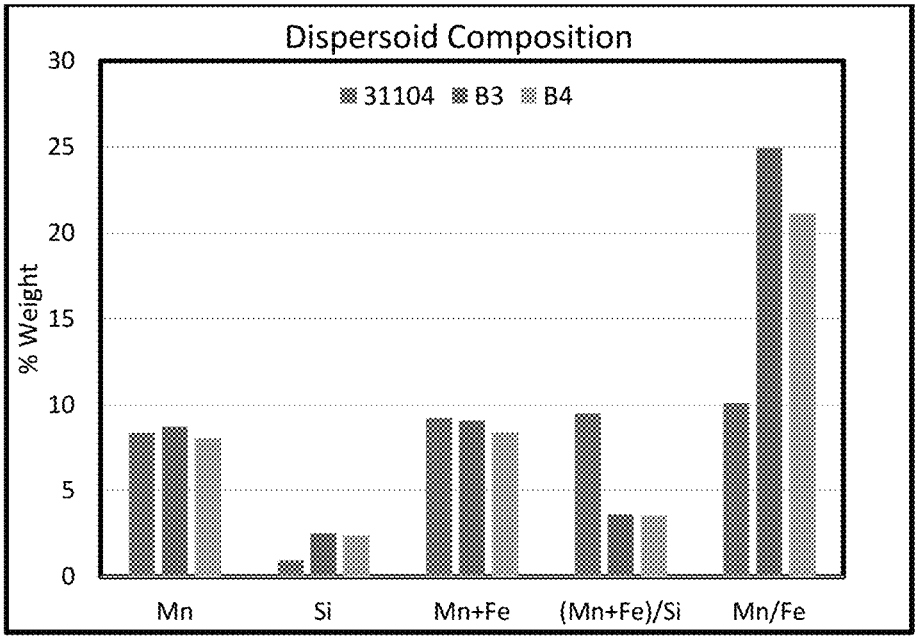
Fig 20. Composition in %weight of dispersoids in 31104, B3 and B4

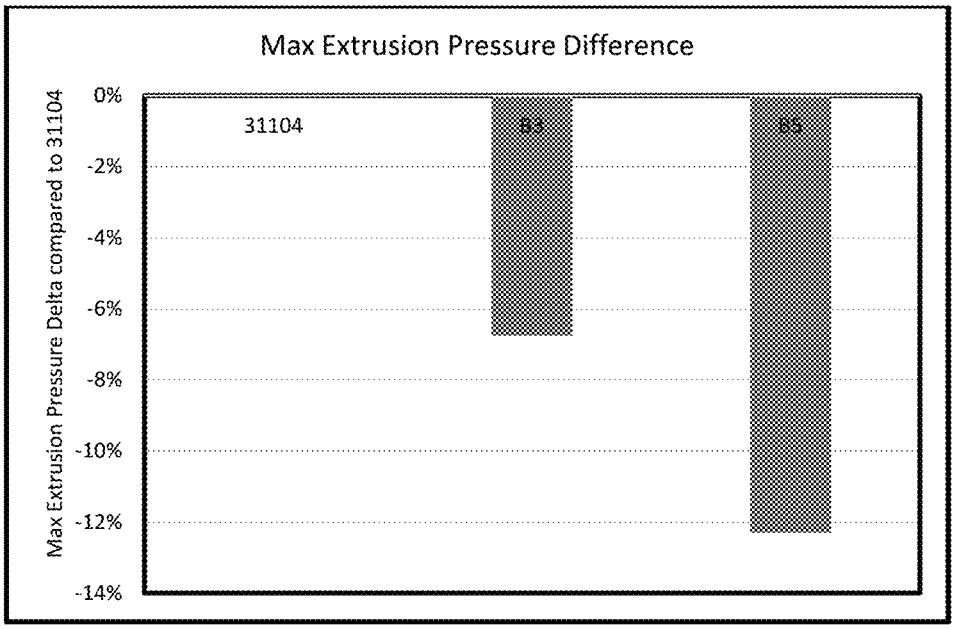
Fig 21. Graph showing comparison between Max Extrusion Pressure of the two development alloys and standard 31104
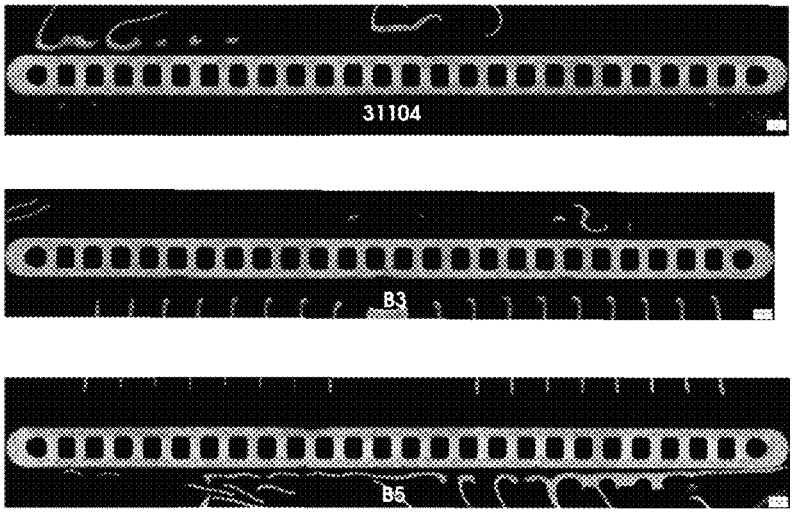
Fig 22. Grain structure of alloys after brazing

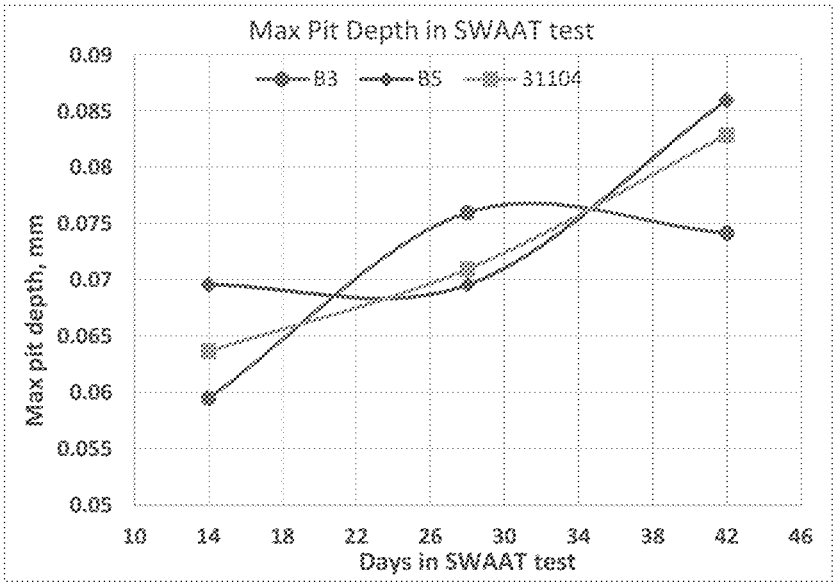
Fig 23. Max Pit depth in SWAAT corrosion test after 14, 28 and 42 days

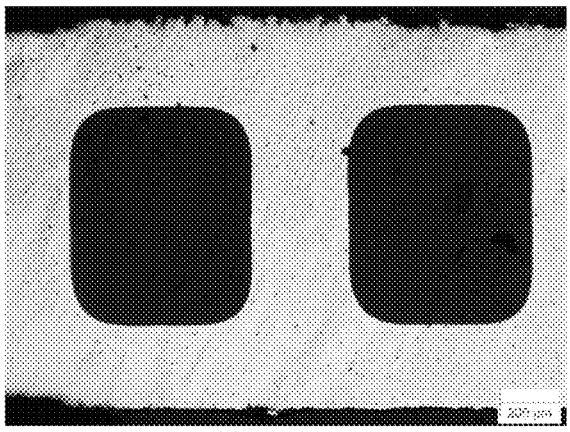
31104 Alloy
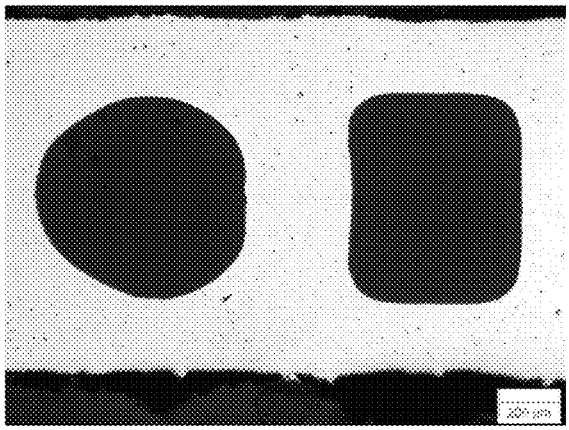
B3 Alloy
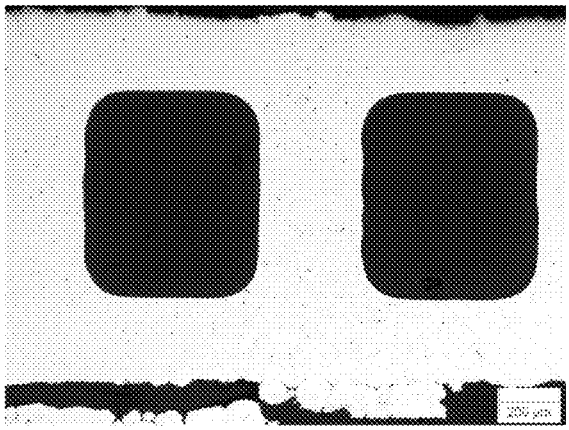
B5 Alloy
Fig 24. Pictures of alloys after SWAAT corrosion tests for 42 days.

CORROSION-RESISTANT ALUMINUM ALLOY FOR HEAT EXCHANGER

CROSS-REFERENCE TO RELATED APPLICATION

The present application claims priority to provisional application No. 62/181,493 filed Jun. 18, 2015, of which the entire disclosure thereof is incorporated by reference.

FIELD

The present disclosure relates to aluminum alloys for a heat exchanger having improved extrudability, superior corrosion resistance, and low cost.

BACKGROUND

This section provides background information related to the present disclosure which is not necessarily prior art.

Aluminum mini-micro-port tubing (MMP) has been used in brazed heat exchangers for automotive condensers and evaporators for the last three decades. The HVAC industry on the other hand predominantly used copper round tubing for heat exchangers. As copper prices saw significant increase in the early 2000s, some HVAC original equipment manufacturers (OEMs) started considering the use of aluminum tubing. Further, field failures of copper heat exchangers from filiform corrosion and significant cost savings propelled the first phase of conversion from copper to aluminum. Unfortunately, HVAC performance requirements were not carefully considered and aluminum MMP that was being successfully used in automotive industry showed a high rate of early field failures in the HVAC market. Several reasons for the early failures include a poor design of the heat exchanger connections and cabinet, the quality of the zinc coating on the MMP tubes, and the aluminum alloy used to manufacture the MMP tube.

Modifications in cabinet design by the OEMs, and improvements in the zinc coating process by MMP manufacturers led to significant improvement in field performance. Further marked improvement came with the research and development of long life alloys from which MMP tubes were manufactured. Specifically, the long life alloy disclosed in U.S. Pat. No. 8,025,748 (widely known as a 31104 alloy) emerged as the dominant long life alloy for the MMP HVAC market.

Under corrosive environments, a 31104 alloy provides a longer life than typical alloys used in this application, such as 1100, 1235, 3102 and 3003 alloys. The corrosion resistance, though, comes at a significant cost premium. A 31104 alloy carries an alloy premium, gives a lower extrusion throughput due to higher flow stress, and lowers extrusion die life. As aluminum penetrates the HVAC heat exchanger market, customers are demanding cost effective solutions. Therefore, there exists a need for a long life corrosion resistant alloy with lower cost and wider availability. This disclosure aims to address the above unfulfilled market demands of lower cost and similar corrosion resistance.

Extruded MMP tube cost is primarily driven by alloy premium, geographical availability and manufacturing cost including extrudability and die life. Extrudability (i.e., ease of extrusion and throughput) and die life primarily result from billet properties and press capability. Billet properties, in turn, are dependent and result from composition and homogenization of the alloy. Another aim of this disclosure, therefore, is to focus on both composition and homogenization in such a way so as to reduce cost by increasing the ease with which the alloy could be processed, and provide similar corrosion resistance to currently available long life alloys.

SUMMARY

This section provides a general summary of the disclosure, and is not a comprehensive disclosure of its full scope or all of its features.

The objective of the disclosure is to provide an aluminum alloy with a combination of (1) corrosion resistance, (2) increased extrudability, and (3) lower cost. Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 1 graphically illustrates the Max Extrusion Pressure difference between alloys according to the present disclosure in comparison to a conventional 31104 alloy;

FIG. 2 is a picture illustrating the grain structure of a conventional 31104 alloy in an as-extruded and post braze state;

FIG. 3 is a picture illustrating the grain structure of B1-A in an as-extruded and post-braze state;

FIG. 4 is a picture illustrating the grain structure of B1-B in an as-extruded and post-braze state;

FIG. 5 is a picture illustrating the post-braze grain structure of B2-A with a different % cold work that is brazed at 602 C;

FIG. 6 is a picture illustrating the post-braze grain structure of B2-B with different % cold work that is brazed at 602 C;

FIG. 7 is picture that illustrates the post-braze grain structure of 31104 with a different % cold work that is brazed at 610 C;

FIG. 8 is picture that illustrates the grain structure of extruded and brazed tubes of 31104, BZY1 and BZY2 alloys;

FIG. 9 is a picture that illustrates corrosion of a conventional 31104 alloy after 7 days in SWAAT;

FIG. 10 is a picture that illustrates corrosion of B1-A after 7 days in SWAAT;

FIG. 11 is a picture that illustrates corrosion of B1-B after 7 days in SWAAT;

FIG. 12 graphically illustrates Corrosion Pit Depths of alloys in SWAAT;

FIG. 13 includes pictures of of tubes after 15 days of SWAAT testing;

FIG. 14 includes grain etched pictures of corrosion in B2-A tubes after 15 days in SWAAT;

FIG. 15 includes pictures of corrosion in B3 tubes after 4 and 7 days in SWAAT;

FIG. 16 includes pictures of corrosion in B4 tubes after 4 and 7 days in SWAAT;

FIG. 17 graphically illustrates the days to failure in SWAAT for 31104, B3 and B4 alloys;

FIG. 18 includes pictures of various billet microstructures of B1-A, B1-B, B2-A and B2-B alloys;

FIG. 19 graphically illustrates the average particle % weight composition of constituent particles along grain boundaries determined by EDS analysis; and FIG. 20 graphically illustrates the composition in wt % of dispersoids in 31104, B3 and B4 alloys;

FIG. 21 graphically illustrates a comparison in max extrusion pressure of the two development alloys (Alloys B3 and B5) relative to a standard 31104 alloy;

FIG. 22 is a picture illustrating the grain structure of a 31104 alloy, an alloy according to a first embodiment of the present disclosure (alloy B3), and an alloy according to a second embodiment of the present disclosure (alloy B5);

FIG. 23 graphically illustrates the max pit depth after a SWAAT corrosion test after 14, 28 and 42 days for alloy according to the present disclosure (alloys B3 and B5) in comparison to a 31104 alloy; and FIG. 24 is pictures of MPP tubes formed from a 31104 alloy, a B3 alloy according to the present disclosure, and a B5 alloy according to the present disclosure after SWAAT corrosion tests for 42 days.

Corresponding reference numerals indicate corresponding parts throughout the several views of the drawings.

DETAILED DESCRIPTION

Example embodiments will now be described more fully with reference to the accompanying drawings.

In order to meet the above-noted objective, an aluminum alloy with the following composition (in weight %) was cast—silicon (Si) in amount that ranges between 0.20 and 0.30; iron (Fe) in amount that is less than or equal to 0.12; manganese (Mn) in an amount that ranges between 0.70 and 0.90; titanium (Ti) in an amount that ranges between 0.05 and 0.20; zinc (Zn) in an amount that is at most 0.03; copper (Cu) in an amount that is at most 0.03; nickel in an amount that is at most 0.006; and a balance of aluminum (Al). The above composition, and proper homogenization of the composition, result in an alloy that has improved extrudability, optimal corrosion resistance, and lower cost.

The composition has a low iron content to reduce susceptibility to pitting corrosion. The manganese amount between 0.70 and 0.90 wt % provides adequate corrosion resistance, with improved extrudability. The titanium amount between 0.05 and 0.20 wt % provides a fibrous, fine pancake grain structure. The low zinc and copper contents are essential to maintain electro-potential balance between the MMP alloy and other aluminum alloys used in the brazed heat exchangers that are in contact with the MMP tubes. The nickel amount was maintained at a level such that it does not negatively affect the alloy premium and corrosion properties.

Homogenization of billets cast from the above-noted composition, wherein the billets are heated to elevated temperatures and soaked for considerable time is performed to attain consistent composition across the billet width, break macro-segregation, and control the quantity of solute in the matrix of the principal alloy and amount of precipitates and dispersoids in the alloy.

A soak temperature and time of the homogenization control the amount of alloying additions that are in solid solution with the matrix, as well as the amount and size of dispersoids that precipitate out of the matrix. The extent of solid solution and dispersoids are critical features in obtaining the desired properties from the alloy, as it influences extrudability, grain structure, corrosion resistance, and mechanical properties.

In the below Table 1, various exemplary alloy compositions according to the present disclosure are listed (in wt %). It should be understood that each exemplary alloy includes a balance of aluminum.

TABLE 1

| | Si | Fe | Mn | Ti | Zn | Cu | Ni |
|---|---|---|---|---|---|---|---|
| B1 | 0.232 | 0.045 | 0.781 | 0.164 | 0.002 | 0.021 | 0.002 |
| B2 | 0.235 | 0.057 | 0.790 | 0.175 | 0.004 | 0.003 | 0.004 |
| B3 | 0.22 | 0.09 | 0.82 | 0.017 | 0.02 | 0.00 | 0.004 |
| B4 | 0.21 | 0.11 | 0.79 | 0.12 | 0.02 | 0.00 | 0.004 |
| B5 | 0.21 | 0.09 | 0.64 | 0.02 | 0.02 | 0.01 | 0.005 |

Alloy Billet Compositions

Billets B1 and B2 were cast with an iron content below 0.08 wt %, which is less than the typical iron content in a long life alloys of a minimum of 0.08 wt %. B1 had slightly higher copper content of 0.021 wt %, whereas B2 had more typical copper content of 0.003 wt %. Because of their low iron contents, B1 and B2 require a higher purity primary metal for casting the billets which comes at a cost premium. Billets B3 and B4, in contrast, allowed for a higher iron content in the range of 0.08 to 0.12 wt %, which does not necessarily require a higher purity primary metal. B1, B2 and B4 included a titanium addition whereas B3 did not have titanium as an alloying addition.

Homogenization

In a typical homogenization process, the as cast billets are heated to temperatures that range between 550° C. to 620° C., soaked at that temperature for several hours, and subsequently cooled to room temperature. The entire process of heating, soaking, and cooling takes several hours. Cooling rate is at times controlled and carried out in steps, which prolongs the time that the billets are in the homogenization furnace, thereby increasing energy cost and decreasing manufacturing flexibility.

With that in mind, several homogenization variations were tested as shown in Table 2. B1 after soaking at a peak temperature, was quenched with room temperature water, which significantly reduced the time in the homogenization furnace. Overall, three different homogenizations were provided to B1 billets. Batch B1-A billets underwent a high soak temperature single step homogenization, Batch B1-B billets underwent a high soak temperature two-step homogenization, and Batch B1-C billets underwent a low soak temperature single step homogenization.

Batch 2 billets were given two different homogenization treatments. Batch B2-A billets were soaked at a temperature of 580° C. and then air cooled, while batch B2-B billets were soaked at a temperature of 610° C. and then air cooled. Air cooling provides a faster rate of cooling than controlled or two step cooling cycles. It thus saves time, energy and increases homogenization furnace throughput.

TABLE 2

Alloys and homogenization procedure

| Alloy | Homogenization |
|---|---|
| 31104 | As available |
| B1-A | 610 C. + water quench |
| B1-B | 610 C. + 450 C. + water quench |
| B1-C | 580 C. + water quench |
| B2-A | 580° C. + air cool |

TABLE 2-continued

| Alloys and homogenization procedure | |
|---|---|
| Alloy | Homogenization |
| B2-B | 610° C. + air cool |
| B3 | 580° C. + Controlled cool |
| B4 | 580° C. + Controlled cool |

Billets B3 and B4 were homogenized by soaking the billets at 580° C. for 4 hours followed by cooling at a controlled rate of 150 to 225° C./hr to 400° C. Subsequently, billets were cooled at a controlled rate down to room temperature.

Extrudability

Determining and comparing the breakthrough extrusion pressure of alloys is an appropriate method to measure extrudability of alloys. A lower extrusion pressure generally points to an easier to extrude alloy, higher throughput, and better surface finish for a given extrusion asset.

In extrusion trials, alloy billets were extruded back to back, and breakthrough pressures were recorded on a 3800 ton extrusion press. Extrusion trials discovered that the B1-B billets had the lowest breakthrough pressure, while the B1-C billets had significantly higher breakthrough pressure. See FIG. 1 for a graphical representation.

The B1-A to B1-C alloys clearly show the effect of using a different homogenization treatment on Maximum Extrusion Pressure and thus extrudability of an alloy. A high soak temperature (i.e., B1-A) results in a lower max extrusion pressure than a low soak temperature (i.e., B1-C) homogenization that is followed by a water quench. Moreover, a two-step homogenization that uses a high peak soak temperature, which leads to a slow cool, results in the lowest max extrusion pressure (i.e., B1-B).

Extrudability tests conducted on the B2 batch billets showed a similar Max Extrusion Pressure in comparison to a 31104 alloy. Even though the soak temperatures were different for the two B2 batches, air cooling, which significantly slows down cooling rate compared with water quench, resulted in both having similar max extrusion pressures.

B3 and B4 billets saw further slowing down of cooling rate and the cooling rate was controlled to 150 to 225° C./hour. The B3 alloy with no titanium addition had a lower max extrusion pressure than B4 alloy with titanium as an alloying addition.

Brazing and Grain Structure

MMP tubes are extruded oversize in width and height in coils and later sized by rollers to target dimensions and cut to lengths. The sizing operation adds about 1-4% cold work to the tube and can lead to grain growth at time of brazing, which is carried out at elevated temperatures of approx. 600° C. Grain size and structure play a crucial role in determining corrosion properties. To evaluate grain structure in the alloys, extruded tubes were cut to size and brazed in a nitrogen atmosphere at 602° C. for 3 minutes. Cross sections of the brazed tubes were mounted and polished for metallographic examination.

FIG. 2 illustrates the grain structure of a 31104 alloy in an as-extruded and post-braze condition. In comparison, FIG. 3 illustrates that B1-A showed fine-small size grain structure throughout the cross section after brazing, and FIG. 4 illustrates that B1-B showed fine-small size grains on the tube surface and webs with few larger grains in the nose area. Thus, B1-A and B1-B both showed fine-small size grain structure post-braze, with B1-A retaining a complete fine-small size grain structure throughout the cross section. Fine grain structure after brazing is preferred as it provides a convoluted and treacherous path for corrosion to progress and extends the corrosion life of alloys After brazing, as shown in FIGS. 5 and 6, B2-A and B2-B showed fine-small size grain structure throughout the cross section. The B2-A and B2-B grains on the surface showed a fibrous pan-cake structure. The B2-A and B2-B alloys were also found to provide stability to the grain structure. Even after brazing at a higher temperature of 610° C. for 3 minutes, B2-A and B2-B alloys showed predominantly fine grains. This provides flexibility to end users in case the brazing furnace has high variability or different size and mass of tubes are brazed together in the brazing furnace. FIG. 7 illustrates the post-braze grain structure of a 31104 alloy with a different percentage of cold work, brazed at 602 C.

FIG. 8 illustrates that B3 and B4 showed fine grains over the entire cross section of the tubes, and that B4 showed a pronounced fibrous and pancake grain structure.

Corrosion SWAAT Test

Cut section coupons 8"-12" length were simulation brazed at 602° C. for 3 minutes and tested for corrosion properties in SWAAT (ASTM G85-A3). These were bare (i.e., no zinc coating) tube sections that were used to evaluate the corrosion resistance of the alloy without influence of any protective coating or diffusion layer. For comparison, FIG. 9 illustrates corrosion of 31104 alloy after 7 days in SWAAT.

B1-A and B1-B tubes showed aggressive corrosion. In this regard, as shown in FIG. 10, B1-A showed an intergranular corrosion mode, and FIG. 11 illustrates that B1-B showed aggressive corrosion leading to failure in 7 days.

In another SWAAT test, coupons of 31104, B2-A, B2-B, B3 and B4 were harvested after 4 and 7 days. Harvested tube section was cleaned with dilute nitric acid solution and visually inspected to identify areas with deepest corrosion. Identified cross section areas were mounted and polished to measure max pit depth. The obtained results are shown in FIG. 12.

As seen in FIG. 12, B2-A and B2-B tubes showed high resistance to corrosion and shallow pit depths after 7 days in SWAAT. B2-B failed in SWAAT between 12 and 15 days and showed lateral corrosion mode as seen in FIG. 13. B2-A showed a slower lateral corrosion mode and was the most corrosion resistant alloy under SWAAT with max pit depth after 15 days of approx 38% of tube wall as shown in FIG. 14. B3 and B4 alloys showed pit depths higher than B2 batch alloys as illustrated in FIGS. 15 and 16. B2, B3 and B4 all showed pit depths lower than 31104 after both 4 and 7 days in SWAAT test.

Superior corrosion performance of B2 batch can be attributed to the fine-small size grain structure post braze, titanium and silicon alloying addition and low iron alloy composition.

The fibrous pancake grain structure of B2-A tubes and composition forced corrosion to progress in a lateral mode instead of a pitting mode. When corrosion spreads laterally in a direction parallel to the tube surface it prevents catastrophic through-the-wall early failures, and extends corrosion life.

As illustrated in FIG. 17, SWAAT test on B3 and B4 alloys showed high corrosion resistance. In this instance, coupons were simulation brazed, pressurized, and connected to a pressure gauge. The pressure gauges were monitored daily to identify time it took for the gauges to lose pressure after leaks due to corrosion in SWAAT. First B3 failure occurred after 11 days, first B4 failure occurred after 12 days, and first 31104 failure occurred after 3 days. The max pit depth results showed that B3 and B4 had similar maximum pit depths after 7 days. Average days to failure was 8 days for 31104, 17 for B3 and 25 for B4.

Corrosion test images show that B3 and B4 have a lateral mode of corrosion (FIGS. 15 and 16). Even when corrosion starts as small pits it turns into lateral corrosion and thus increases the corrosion life. The pronounced fibrous and pancake grains in B4 show their influence on corrosion and force corrosion to move lateral along the surface of the tube.

Homogenization Effect on Developmental Alloys

Homogenization affects billet microstructure which plays a crucial role in determining extrudability and post fabrication grain structure. Post braze grain structure is critical to corrosion resistance.

Referring to FIG. 18, billet microstructure of alloy B1-A showed least number of dispersoids and widest Precipitate Free Zone (PFZ) along the grain boundaries. This could be explained by the high homogenization temperature leading to dissolution of dispersoids and precipitates back into the aluminum matrix and rapid water quench resulting in fewer dispersoids and a cleaner looking microstructure. B2-A showed greater number of dispersoids and narrowest PFZ. Low homogenization temperature in B2-A did not allow dispersoids to dissolve back into the matrix and a slower air cool resulted in formation of greater number of dispersoids.

B3 and B4 showed a large number of dispersoids. Greater number of dispersoids means most of the alloying elements have precipitated out of the matrix as dispersoids and this less quantity is in solid solution Electron Dispersive Spectroscopy (EDS) analysis conducted to determine composition showed that the constituent particles along the grain boundaries in the developmental alloys had higher % weight of silicon (FIG. 19). This is believed to result due to higher concentration of silicon in these alloys.

Although developmental alloys have lower Mn, the Fe+Mn content of the constituent particles is significantly greater than in 31104. This shows that constituent particles in developmental alloys constitute Al, Mn, Si and Fe, Although Mn levels in B3, B4 and 31104 dispersoids are similar, B3 and B4 alloys showed high Mn/Fe ratio averaging between 20 and 25 (FIG. 20). High Fe content in dispersoids make them anodic to aluminum matrix, so a high Mn/Fe ratio seen in B3 and B4 is favorable. Also, dispersoids in B3 and B4 alloys showed higher content of Si.

The number density of dispersoids in brazed tube was calculated using SEM software and the results are shown in Table 3. Dispersoids are tiny intermetallic precipitates formed during homogenization and are known to pin grain boundaries and inhibit grain growth. High dispersoid density in B3 and B4 explain the fine grain structure achieved in their tubes after brazing.

TABLE 3

Alloys dispersoid number density, conductivity and electropotential

| Alloy | Dispersoid number density in brazed tube (number/100 $\mu m^2$) | Billet Conductivity (% IACS) | Electropotential (mV) |
|---|---|---|---|
| 31104 | 6.1 | 35-38 | −0.719 |
| B3 | 20.7 | 40-46 | −0.754 |
| B4 | 17.4 | 37-43 | −0.761 |

EDS analysis was performed on dispersoids of B3, B4 and 31104 alloys. Dispersoids in B3 and B4 showed a low ratio of (Mn+Fe)/Si which is similar to observation made on constituent particles along grain boundaries. Another significant observation was the high Mn/Fe ratio ration in dispersoids of B3 and B4.

Conductivity

Conductivity of billets is a measure of amount of alloying elements in solid solution. Greater amount in solid solution results in a lower conductivity and vice versa. Conductivity is thus used to evaluate effectiveness of homogenization.

As shown in the Table 3, B3 showed highest conductivity between 40 and 46 confirming that most of the alloying additions had precipitated out and were present in constituent particles and dispersoids. The high billet conductivity of B3, also explains its low extrusion pressure. As Mn, Si and other alloying additions precipitate out, the flow stress required to extrude decreases.

Electro-Potential

Open Circuit potential (OCP) is an indicator of corrosive nature of a metal. One inch long microchannel tube sections were cut and surface was cleaned before measuring electro-potential relative to a standard electrode. Multiple measurements were performed according to ASTM procedure and average electro-potentials are listed in Table 3. B3 had an electro-potential of −0.754 eV and B4 had an electro-potential of −0.761 eV. B3 was closest to 99.9% pure aluminum electro-potential of −750 mV (reference). This shows that most of the alloying additions in B3 and B4 were present in constituent particles and dispersoids. It is believed that a lower electro-potential, as with B3 and B4, is key to inhibiting intergranular corrosion. Lower electro-potential, like that in B3 and B4, means low electro-potential difference between the grains and grain boundaries, which provides smaller driving force for galvanic corrosion progressing along grain boundaries.

Based on the supporting data, the B3 alloy/homogenization combination, with the properties described above, offers the mix of extrusion and corrosion properties and is therefore superior to other solutions.

In one embodiment, as noted above, the aluminum alloy includes silicon in amount that ranges between 0.15 and 0.30 wt %; iron in amounts that range less than or equal to 0.15 wt %; manganese in amounts that range between 0.70 and 0.90 wt %; zinc in an amount of no greater than 0.03 wt %; copper in amount of no greater than 0.03 wt %, nickel is an amount of no greater than 0.01 wt % with a balance of aluminum is utilized to maximize corrosion resistance and exhibit improved extrusion properties.

In a second embodiment, the manganese level is lowered to amounts that range between 0.50 and 0.70 wt % to improve extrusion properties even further. See, for example, alloy B5 in Table 1, above. While this embodiment will have reduced corrosion resistance as compared to the first embodiment, the alloy will meet the requirements of many applications at a reduced cost.

As noted above, the primary difference between alloys of the first embodiment (i.e., alloy) B3 and alloys of the second embodiment (i.e., alloy B5) is the amount of manganese contained in the alloy composition. In this regard, alloy B5 has a manganese content of 0.64 wt %, whereas alloy B3 had a manganese content of about 0.80 wt %. A billet of alloy B5 and a billet of alloy B3 were each homogenized between 570° C.-600° C. for 4 hours, and cooled at a controlled rate. Conductivity of the homogenized B3 billets was between 40 and 46% IACS, and conductivity of the B5 billets was between 41 and 47% IACS. Each of the homogenized aluminum alloy B3 and B5 billets were extruded on a 3800 ton extrusion press.

As can be seen in FIG. 21, the difference in maximum extrusion pressure was recorded while extruding the billets. Alloy B3 showed approximately a 6% lower maximum extrusion pressure when compared with a 31104 alloy, while alloy B5 showed approximately a 12% lower maximum extrusion pressure.

Next, MPP tubes that were arc spray zinc coated were assembled with louvered fins and header tubes, and brazed to form mini-cores. Grain structure of different alloys after brazing is shown in FIG. 22.

Further, a SWAAT ASTM G85 A3 corrosion test was performed on each of the mini-cores. The mini-cores were pressurized to 250 psi and corrosion tested. One mini-core was removed from the test after 2, 4 and 6 weeks, respectively. Sections of tubes were metallographically examined to determine the deepest corrosion pit. As shown in FIG. 23, alloy B3 started to flatline in pit depth whereas alloy B5 and alloy 31104 showed increasing pit depths. Thus, it can be seen that alloy B3 has the best combination of extrudability and corrosion properties, and alloy B5 has the best extrudability.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An extrudable aluminum alloy for a micro channel and round tube heat exchanger application consisting essentially of:

silicon in an amount that ranges between 0.21 and 0.30 wt %;

iron in an amount that is less than or equal to 0.15 wt %;

manganese in an amount that ranges between 0.50 and 0.90 wt %;

zinc in an amount of no greater than 0.03 wt %;

copper in an amount of no greater than 0.03 wt %;

nickel in an amount of no greater than 0.01 wt %; and a balance of aluminum, wherein the aluminum alloy has a dispersoid number density in the range of 16 to 23 per 100 square microns.

2. The extrudable aluminum alloy of claim 1, wherein the alloy is casted as a billet and homogenized, wherein homogenization includes soaking the billet at a temperature that ranges between 575° C. and 625° C. and cooling the billet at a controlled rate ranging between 150° C./hour and 225° C./hour.

3. The extrudable aluminum alloy of claim 2, wherein the billet has a conductivity (% IACS) between 37 and 46 after homogenization.

4. The extrudable aluminum alloy of claim 1, wherein the alloy exhibits an electro-potential that ranges between −745 and −775 mV.

5. The extrudable aluminum alloy of claim 1, wherein the manganese content is in the range of 0.50 and 0.70 wt %.

6. The extrudable aluminum alloy of claim 1, wherein the manganese content is in the range of 0.70 and 0.90 wt %.

7. A method of manufacturing an aluminum alloy billet, comprising:

forming an aluminum alloy that consists essentially of silicon in an amount that ranges between 0.21 and 0.30 wt %; iron in an amount that is less than or equal to 0.15 wt %; manganese in an amount that ranges between 0.50 and 0.90 wt %; zinc in an amount of no greater than 0.03 wt %; copper in an amount of no greater than 0.03 wt %; nickel in an amount of no greater than 0.01 wt %; and a balance of aluminum;

casting the aluminum alloy into a billet;

homogenizing the billet by heating the billet to a temperature in the range of 550° C. to 625° C.;

soaking the billet at the temperature; and cooling the billet to room temperature, wherein the billet has a dispersoid number density in the range of 16 to 23 per 100 square microns.

8. The method of claim 7, wherein the step of cooling includes cooling the billet at a controlled rate of 150° to 225° C./hour.

9. The method of claim 7, further comprising extruding the billet into a tube and brazing the extruded tube, wherein the extruded tube after brazing has a small grain structure.

10. The method of claim 7, wherein the billet has a conductivity (% IACS) between 37 and 46.

11. The method of claim 7, further comprising extruding and brazing the alloy.

12. The method claim 7, wherein the alloy exhibits an electro-potential that ranges between −745 and −775 mV.

13. The method of claim 7, wherein the manganese content is in the range of 0.50 and 0.70 wt %.

14. The method of claim 7, wherein the manganese content is in the range of 0.70 and 0.90 wt %.

15. The extrudable aluminum alloy according to claim 1, wherein the amount of nickel is in the range of 0.002 to 0.01 wt %.

16. The method of claim 7, wherein the alloy includes an amount of nickel that is in the range of 0.002 to 0.01 wt %.

* * * * *